US008434966B1

(12) United States Patent
McFarland

(10) Patent No.: US 8,434,966 B1
(45) Date of Patent: May 7, 2013

(54) SEQUENCED CHAMBER WAVE GENERATOR APPARATUS AND METHOD

(76) Inventor: Bruce McFarland, Solana Beach, CA (US)

( * ) Notice: Subject to any disclaimer, the term of this patent is extended or adjusted under 35 U.S.C. 154(b) by 0 days.

(21) Appl. No.: 13/411,520

(22) Filed: Mar. 3, 2012

(51) Int. Cl.
*E04H 4/00* (2006.01)

(52) U.S. Cl.
USPC ..... 405/79; 405/80; 4/491; 472/128

(58) Field of Classification Search ..... 405/79, 405/80; 4/491; 472/128
See application file for complete search history.

(56) References Cited

U.S. PATENT DOCUMENTS

| | | | | |
|---|---|---|---|---|
| 2,406,413 | A | 8/1946 | Test | |
| 3,105,456 | A | 10/1963 | Gongwer | |
| 3,350,724 | A | 7/1964 | Leigh | |
| 3,473,334 | A | 10/1969 | Dexter | |
| 3,577,570 | A | 5/1971 | Vincent | |
| 3,629,877 | A | 12/1971 | Schuster | |
| 4,062,192 | A * | 12/1977 | Biewer | 405/79 |
| 4,276,664 | A | 7/1981 | Baker | |
| 4,467,483 | A | 8/1984 | Bastenhof | |
| 4,515,500 | A * | 5/1985 | Bastenhof | 405/79 |
| 4,522,535 | A * | 6/1985 | Bastenhof | 405/79 |
| 4,558,474 | A | 12/1985 | Bastenhof | |
| 4,692,949 | A | 9/1987 | Dunn | |
| 4,730,355 | A | 3/1988 | Kreinbihl et al. | |
| 4,730,807 | A | 3/1988 | Miller | |
| 4,812,077 | A | 3/1989 | Raike | |
| 4,979,244 | A | 12/1990 | Bastenhof | |
| 4,999,860 | A | 3/1991 | Chutter et al. | |
| 5,098,222 | A | 3/1992 | Robinson | |
| 5,186,578 | A | 2/1993 | Perslow | |
| RE34,407 | E | 10/1993 | Frenzl | |
| 5,342,145 | A | 8/1994 | Cohen | |
| 5,405,250 | A | 4/1995 | Vowles | |
| 5,535,702 | A | 7/1996 | Idbeis | |
| 5,621,925 | A * | 4/1997 | Bastenhof | 4/491 |
| 6,475,095 | B1 | 11/2002 | Henry | |
| 6,729,799 | B1 | 5/2004 | Raike | |
| 6,738,992 | B2 | 5/2004 | Lochtefeld | |
| 6,912,738 | B2 | 7/2005 | Black | |
| 6,920,651 | B2 | 7/2005 | Roberts | |
| 7,666,104 | B2 * | 2/2010 | Lochtefeld | 472/117 |
| 7,815,396 | B2 | 10/2010 | McFarland | |

FOREIGN PATENT DOCUMENTS

| | | |
|---|---|---|
| JP | 05-202626 | 8/1993 |

* cited by examiner

*Primary Examiner* — Tara M. Pinnock
(74) *Attorney, Agent, or Firm* — Manuel F. de la Cerra

(57) ABSTRACT

A wave generating apparatus and method is provided in which a controller actuates a plurality of wave generating chambers in sequence using a delay between actuation of each chamber to produce a rideable wave in a pool. The actuation delay period may be a predetermined proportion of the chamber period. The amount of delay in the sequence can determine the direction that the peak of the wave travels and the amplitude of the peak. Through the sequencing, the peak of the wave produced can travel in a direction not substantially perpendicular to the wave generating chambers.

18 Claims, 6 Drawing Sheets

SEQUENCED CHAMBER WAVE GENERATOR APPARATUS AND METHOD

1.0 TECHNICAL FIELD

The present application relates to wave generators, such as, for example, wave generators for making waves in pools for recreational purposes.

2.0 BACKGROUND

Wave generators are often used for recreational purposes. Wave generators create one or more waves in a pool or the like, and people typically either play in the waves or use the waves for aquatic sports such as board sports. Aquatic board sports, such as surfing and boogie boarding, require that the waves be rideable. Enthusiasts in these types of sports often use wave generators for competition, practice and entertainment.

Existing wave generators typically use wave generating chambers to produce a wave that travels perpendicular to the wave generating apparatus. The wave is produced when the wave generating chambers (either one chamber or multiple chambers) are all activated simultaneously, resulting in the water being pushed away from the wave generating chambers, which then travels at an angle perpendicular to the chambers. The wave then travels away from the chamber until it reaches the opposite end of the pool, breaking at some point between the wave generating chamber and the opposite end of the pool. The waves that are created from these chambers, however, can only be ridden for only a short period of time and distance because after the wave is created, it begins to decrease in amplitude and quickly becomes unrideable. Japan App. No. 04-037314 (JPO Publication No. 05-202626) discloses a pool that produce waves that travel in a perpendicular direction from one side toward the other side of the pool. The side walls of the pool are in a fan shape to allow persons to ride the wave longer and avoid hitting the wall. This apparatus, however, only produces waves that travel perpendicularly away from generating apparatus until the wave reaches the opposite end of the pool. This apparatus attempts to provide for a longer ride on the wave by simply angling the walls in a fan shape, but does not compensate for the wave losing amplitude and strength.

The ring wave type of pool (U.S. Pat. No. 6,920,651) discloses an annular or "doughnut" shaped pool that contains wave generating paddles on the outer wall of the pool that push the water radially inward, from a deep outer diameter region to a shallow inner diameter region. The paddles actuate in a synchronous manner, one after the other, causing the water to circulate around the annulus. This synchronized pushing of the water inward toward a shallow region would create a small, ever-turning wave that follows the circular path of the pool. The waves would be small because paddles, as shown in FIGS. 2 and 3, could not displace a large, fast-moving and directed flow of water. The paddles essentially create minor, slow-moving displacements of the circulating water, leading to small waves at the shoreline, somewhat like the wake of a boat hitting the shore of a river or lake. Further, the angle of the waves to the shoreline would be largely dictated by the geometry of the structure. Specifically, the waves would necessarily follow the "pinwheel" shape shown in FIG. 1; waves could not be created that moved differently, such as substantially perpendicular to the outer surface of the island. Additionally, the waves would always be arc-shaped, not substantially straight-lines like most naturally occurring waves in the ocean. Also, the waves do not break and become rideable until they are a far distance from the wave generating paddle because the wave cannot break until it reaches the breakpoint on the floor of the pool, which is the peak of a long inclined slope on the floor of the pool. Therefore, this apparatus is extremely large with a significant portion of the water surface having no rideable wave. Indeed, users would be in danger if they did not stay close to shore, because they could be seriously injured by the paddles. In fact, if a user could not swim or for some reason sank to the bottom, they would tend to slide down the slope straight into the moving paddle. In sum, constructing and maintaining such an apparatus would be extremely expensive, with only small, non-realistic waves produced near the shore, all while presenting a serious risk of injury to users.

What is needed is an apparatus that overcomes the shortcomings of the prior art, including providing a rideable wave that compensates for the wave losing amplitude and strength as it moves across the pool.

3.0 SUMMARY

Provided is a new and improved wave generator apparatus and method that in various example embodiments may include sequenced chambers adapted to create a rideable wave that travels in a direction that is not perpendicular to the wave generating apparatus such that the wave strength continues to be replenished by the wave generator as it moves across the pool. In one example embodiment, a wave generating apparatus has a pool that holds water, the pool having a first end, second end, two sides, and a floor. The first end of the pool may contain a plurality of wave generating chambers. A controller may be connected to the chambers. The controller operation may actuate the first chamber in the plurality to release water into the pool. After a delay, the controller may actuate the second chamber to release water into the pool, and after a delay, the controller may actuate a third chamber to release water into the pool. This process may continue and repeat with each chamber in the plurality. The wave generator apparatus may be adapted to create waves where the peak of the wave travels in a direction that is not substantially perpendicular to the ends of the pool or the chambers.

In various example embodiments the delay between the chamber actuations may be a fraction of the chamber period, such as approximately 0.10 to 0.75 of the chamber period. The fraction can be adjusted to modify the travel direction and the amplitude of the wave peak.

The amount of delay in the sequence may determine the trajectory of the wave. When the sequence uses no delay between activating chambers, the wave may travel in a perpendicular direction away from the chambers. An increase in the delay may result in the peak traveling more towards the side of the pool. The delay sequence can produce a wave peak that travels not substantially perpendicular to the chambers until it reaches the side. Such a wave can be ridden. The activation of each chamber in sequence causes the peak of the wave to increase in size until it reaches its maximum size. The peak amplitude of the wave created with sequencing may be roughly twice that of the amplitude of a wave created without sequencing that travels perpendicular to the chambers.

Other aspects of the invention are disclosed herein as discussed in the following Drawings and Detailed Description.

4.0 BRIEF DESCRIPTION OF THE DRAWINGS

The invention can be better understood with reference to the following figures. The components within the figures are not necessarily to scale, emphasis instead being placed on clearly illustrating example aspects of the invention. In the figures, like reference numerals designate corresponding parts throughout the different views. It may be understood that certain components and details may not appear in the figures to assist in more clearly describing the invention.

Figure 8:
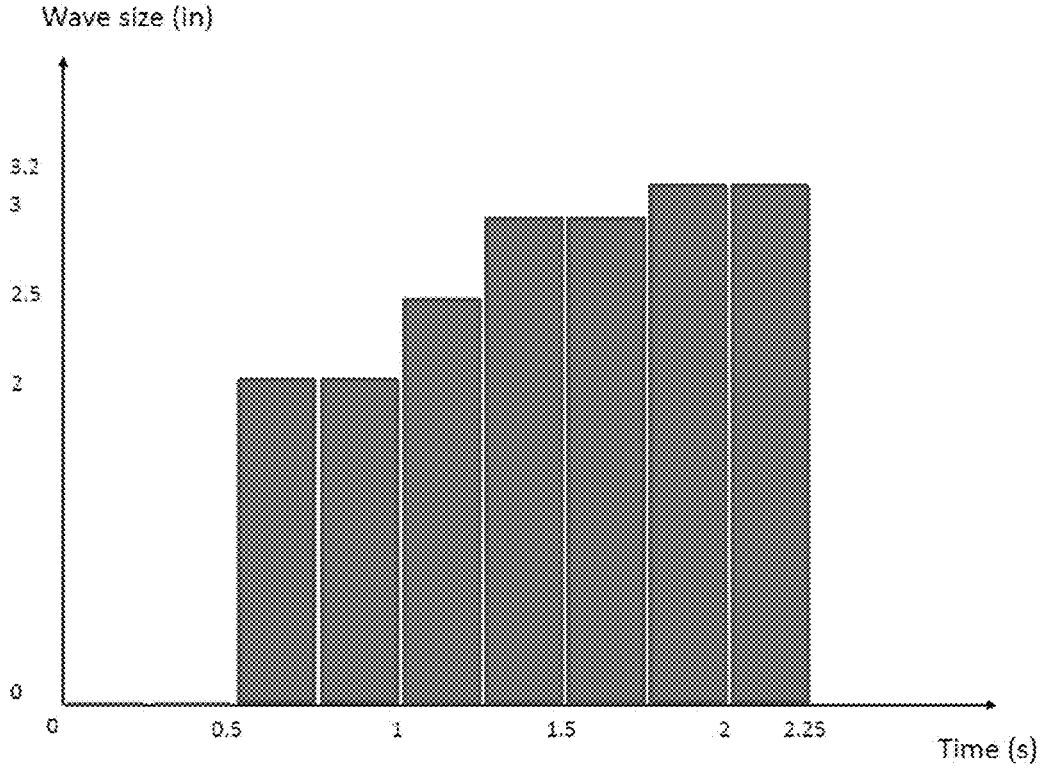

FIG. 8 is a modeling graph showing the size of the wave and the amount of time it takes the wave to reach that size. The wave size is for a wave using sequencing. The measurements were taken using a small-scale version of the apparatus with nine chambers.

5.0 DETAILED DESCRIPTION

Following is a non-limiting written description of example embodiments illustrating various aspects of the invention. These examples are provided to enable a person of ordinary skill in the art to practice the full scope of the invention without having to engage in an undue amount of experimentation. As may be apparent to persons skilled in the art, further modifications and adaptations can be made without departing from the spirit and scope of the invention, which is limited only by the claims.

The apparatus disclosed herein in various example embodiments provides a sequenced chamber wave generating apparatus that may be adapted for use with aquatic board sports or any other suitable purpose, such as miniature modeling of wave formations. The apparatus overcomes the deficiencies in the prior art by creating rideable waves that travel in a direction that is not perpendicular to the wave generating apparatus such that the wave strength continues to be replenished as the waves move across the pool.

Figure 1:
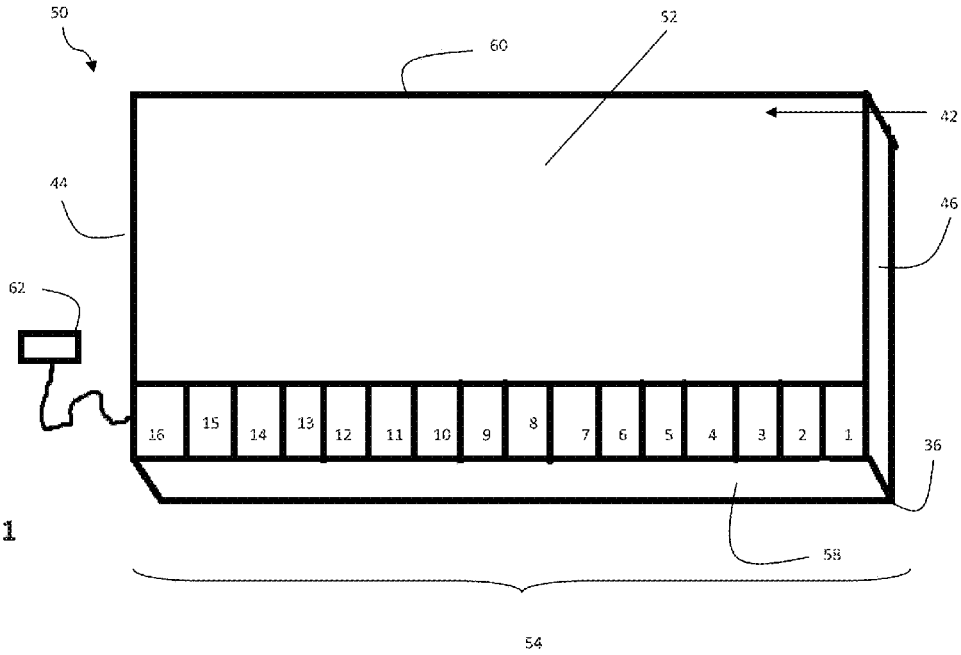
FIG. 1 is a top view of one example embodiment of a wave generator apparatus in a wave pool with sixteen chambers.

FIG. 1 illustrates an example embodiment of a wave generator apparatus, which comprises a pool or container 50, a body of water 52, a plurality of wave generating chambers 54 (each chamber is individually numbered 1-16), and a controller 62 to operate the chambers 54. In this example embodiment, there are sixteen wave generating chambers 54. Although there is no specifically required number of wave generating chambers 54 (other example embodiments include twenty-four and thirty-two chambers), too few chambers 54 in the apparatus may not be able to produce enough slices to create a wave that can be ridden. In one example embodiment, each chamber is 10 ft×5 ft×3 ft, giving each chamber a capacity of 150 cubic feet. Other example embodiments may have wave generating chambers as big as 260 cubic feet or more; but it would be apparent to those skilled in the art to modify the size and water displacement of the chambers.

The pool 50 may be rectangular shaped and holds the body of water 52. The pool 50 has a first end 58, a second end 60, two sides 44, 46, and a floor 36. The first end 58 is comprised of a plurality of chambers 54 adjacent to one another and the second end 60 is at the opposite end of the pool where the beach 42 is located. The two sides 44, 46 are at opposite ends of the pool 50. The first end 58, second end 60, and two sides 44, 46 act as walls for to pool 50 to contain the body of water 52 along with the floor 36 that is under the body of water 52. The body of water 52 rests in the pool 50 and is in a still state until the chambers 54 begin to actuate in sequence and create a wave using the body of water 52 in the pool 50.

Figure 2:
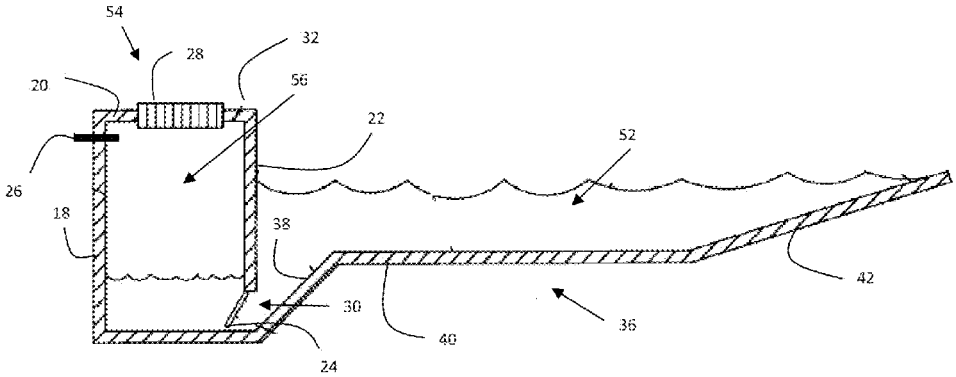
FIG. 2 is a cross-section of FIG. 1, illustrating one example embodiment of a wave generating chamber in a wave pool.

FIG. 2 illustrates an example embodiment of a single wave generating chamber 54, which can comprise of a chamber space 56 having a back wall 18, an upper wall 20, and a reflecting wall 22 at the rear wall of the pool that faces the body of water 52 in the pool 50. An example may be that of U.S. Pat. No. 7,815,396 to McFarland, the same inventor of the present application, and the contents of that patent are incorporated herein by reference. A passageway 30 at the lower end of wall 22 allows communication between the chambers 54 and the body of water 52 in the pool. A mechanical two-way valve 24 may be located in passageway 30.

The chambers 54 may be connected to an air supply through inlet valve 26 located close to the upper end of the chamber back wall 18 and is also connected to a vent valve 28 in the upper wall 32, which may be connected to a vacuum pump. The floor 36 of the pool may have a first, upwardly inclined portion 38 extending from passageway 30 away from the wave reflecting wall 22, a generally flat portion 40, and an upwardly inclined portion or beach 42 at the opposite, second end 60 of the pool 50.

In operation of this example embodiment, the chamber 54 is first filled with air through valve 26, thereby displacing water into the pool 50. Valve 26 is then closed and the chamber air is vented suddenly through vent valve 28, causing the water 52 to flow from the pool 50 through passageway 30 into the now empty space 56 in the chamber 54. The water level in pool drops suddenly, creating a depression or trough in the water that reflects against the back or wave reflecting wall 22 of the pool 50. This creates a circulating motion of the water, which is enhanced by the design of the back wall. The vent valve 28 in the air chamber is shut at the proper time to prevent immediate water resurgence back into the pool 50, which enhances the second trough behind the peak. The mechanical two-way valve 24 can also be used to prevent immediate resurgence. The water valve 24 may be closed during the initial air fill phase to create a larger air volume in the chamber which, when released, creates a larger depression in the pool. Alternatively, air valve 26 can rapidly supply pressurized air to the chamber after the chamber is filled with water to push water out and amplify the wave peak. This process of pushing water out of the chamber and into the pool is known as releasing water. Alternatively, vent valve 28 may be connected to a vacuum source such as a vacuum pump, or may be a vent outlet connected via suitable valving either to atmosphere or to a vacuum source.

Figure 2A:
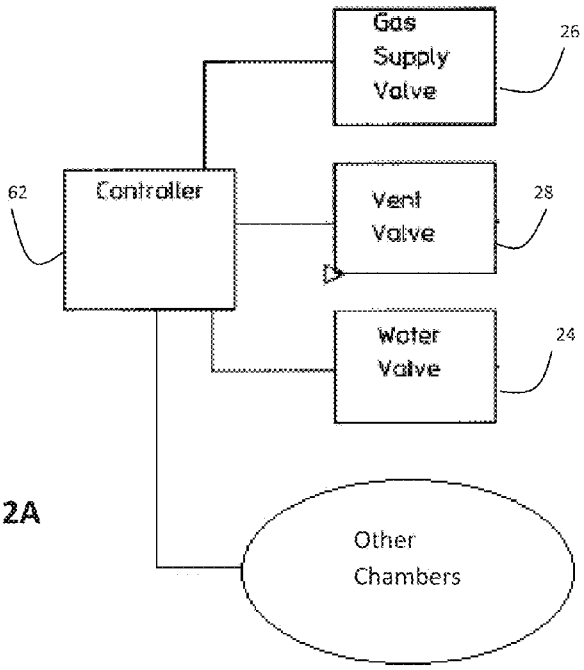
FIG. 2A is a schematic block diagram of a control system for controlling operation of the sequencing of delay between actuating each chamber in the apparatus in FIGS. 1-2.

As illustrated schematically in FIG. 2A, the electronic controller 62 may be connected to the valves 26, 28 and 24 in order to control the operation in the manner described above. The controller 62 controls this operation for each chamber, such that the controller 62 actuates each of the chambers in sequence. The controller 62 may begin by actuating the first chamber in the plurality. After a delay, the controller 62 actuates the second chamber in the plurality, and, after a delay, actuates the third chamber in the plurality. This may continue for a fourth chamber or any number of additional chambers. The controller 62 continues actuating each chamber in the plurality after a delay. FIG. 2A illustrates that the controller 62 controls the valves in each chamber so that after actuating the first chamber it can control the valves in that chamber and, after as delay, actuate the second chamber and control its valves. The controller 62 can actuate each chamber in sequence after a delay and control the valves.

Figure 3:
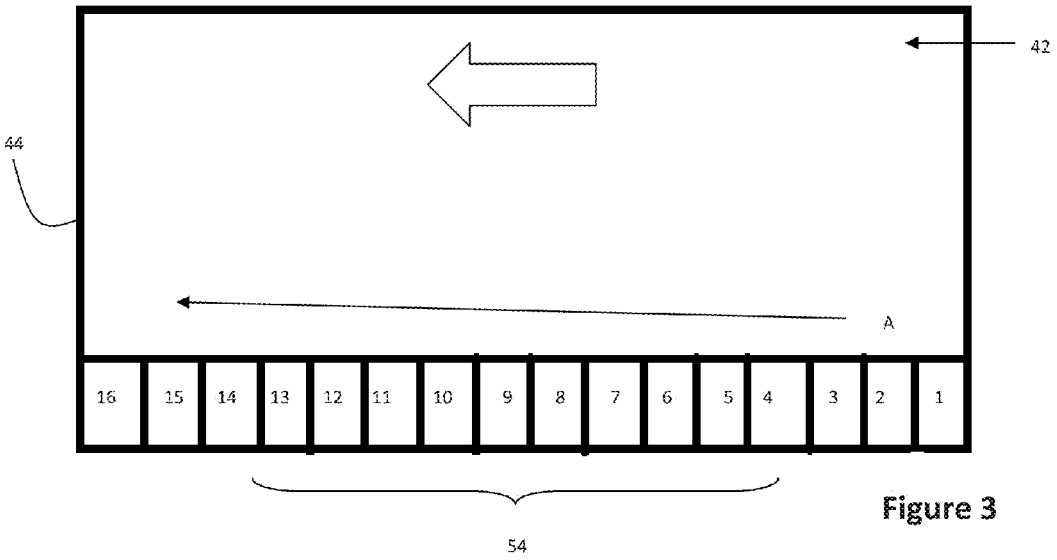
FIG. 3 is a top view of one example embodiment of a wave generator apparatus in a wave pool showing the direction that the wave may travel.

The wave generator apparatus has the ability to create waves where the peak of the wave travels in a direction that is not substantially perpendicular to the ends of the pool and the chambers, as illustrated in FIG. 3. The peak of the wave is defined as the highest water level in the pool. The direction the peak travels is the path that the peak of the wave flows during the life of the wave. Although the wave may reach the beach end 42 of the pool opposite the chambers, the wave peak may continue to travel in a direction that is not perpendicular to the chambers 54.

To create a wave where the peak travels in a direction that is not substantially perpendicular to the chambers 54, the controller 62 may actuate the chambers 54 in a sequence with a delay between actuating each chamber, as described above. The delay is approximately a fraction of the chamber period. In the present example embodiment, sixteen chambers 1-16 are used to produce a wave that can be ridden and the peak travels not substantially perpendicular to the chambers 54 in direction A.

The sequence starts with chamber 1 and continues sequentially (in lowest to highest numerical order of the chambers) down the plurality of chambers, which determines the direction of the wave. The wave breaks nearly right out of the chamber, and the break of the wave allows the peak to travel in a direction not substantially perpendicular to the chambers. Thus, a rider is able to ride the wave over much of the pool's water surface area. The peak continues until it reaches the side 44 of the pool 50. Although the path that the peak of the wave travels is not exactly parallel to the chambers 54, the pool may be constructed such that the peak may reach the side wall 44 before the peak could reach the opposite, beach end 42 of the pool. As each chamber actuates, the apparatus replenishes the wave to continue its momentum such that the wave can continue to be ridden.

Immediately after a chamber 54 is activated, it creates a trough in the body of water 52 by allowing the water to enter the chamber space 56. The trough is created outside of the chamber 54 where the water entered the chamber 54. When the chamber 54 pushes or releases the water out to create a wave, the water flows into the area previously vacated and is now a trough. The sequencing allows the wave to travel not substantially perpendicular to the chamber 54 and break to create a wave.

The fraction of delay between actuating each chamber may be proportional to the chamber period. The chamber period is the time it takes a chamber to release the water and refill to the predetermined level. To refill, the chamber 54 may permit a fixed amount of water, if any, to reenter the chamber 54. When a chamber completes its period, the chamber is prepared to actuate again. To create a peak that travels not substantially perpendicular to the chambers 54, in A direction, the controller operation may actuate each chamber, using a delay, in sequenced fashion. For example, while chamber 1 is in the wave production portion of its period, the controller 62 actuates chamber 2 and it begins its period. This sequence is repeated with each chamber using the same delay, with the controller 62 operating the sequencing.

The controller operates the sequenced fashion or sequencing, which comprises each chamber in the plurality actuating after a delay and completing a chamber period. The fraction of the chamber period that is used as the delay by the controller 62 is approximately between 0.75 and 0.10. The amount of delay in the sequence can be adjusted within this range to adjust the amplitude of the wave and the direction the peak may travel. Also, the delay may vary between adjacent chambers.

By way of example only, a delay of 0.25 can create a wave traveling in direction A as illustrated in FIG. 3. The 0.25 delay means that the controller 62 may actuate chamber 2 when chamber 1 has completed 0.25 of its chamber period. Likewise, the controller 62 may actuate chamber 3 when chamber 2 has completed 0.25 of its chamber period. This delay may continue in the entire sequence.

When a chamber 54 is half of the way completed with the process of pushing out the water or air needed to create a wave (i.e., 0.25 of the entire chamber period), the subsequent chamber can activate in the sequence. This allows the wave to continue in the desired direction A. For example, in the example embodiment in FIG. 3, each chamber period is completed in four seconds. Therefore, the delay in the sequence would be set at one second, which is 0.25 of the chamber period. When the entire sequence is completed, a new wave can then be produced using the same sequence. While this example uses 0.25 of the chamber period as the delay in the sequence, similar waves can be created with timing delays that are sequenced to actuate a chamber 54 when the previous chamber 54 is in the process of the wave generating phase of the chamber period.

The amplitude or height of the peak of the wave created generally depends on the size of the wave generating apparatus. However, using this sequencing method, the peak traveling in direction A has an amplitude of nearly twice that of the peak traveling perpendicular to the chambers 54 in direction C. The peak of the wave may increase as it builds through the first few chambers in the sequence until it reaches its maximum height. For example, using the example embodiment in FIGS. 1, 3, with chambers 54 that are 150 cubic feet, the wave reaches about six feet in height. Conversely, a wave without sequencing that travels in a direction perpendicular to the wave generating chambers 54, in direction C, may reach a height of about three feet.

For example, using a small version of the wave generating apparatus with only nine chamber 54 (as illustrated in FIG. 8) and a sequence with 0.25 delay, a trough is created at 0.5 seconds, and the wave dramatically starts to build at 0.75 seconds, which is roughly when the third chamber is actuated. The wave has a peak of 2 inches at this point, which is a dramatic increase from 0.5 seconds when the wave size was 0 inches. At about 1.25 seconds, the wave starts to crest just past the third chamber, when the peak reaches 2.5 inches. The wave's peak heightens to 3 inches when it reaches the fourth chamber. This occurs at 1.5 seconds, which coincides with when the sixth chamber is actuated by the controller 62. At 2 seconds, the peak reaches its maximum height of 3.2 inches. Conversely, a wave traveling perpendicular to the chambers 54 has a maximum peak height of only 2 inches.

Figure 6:
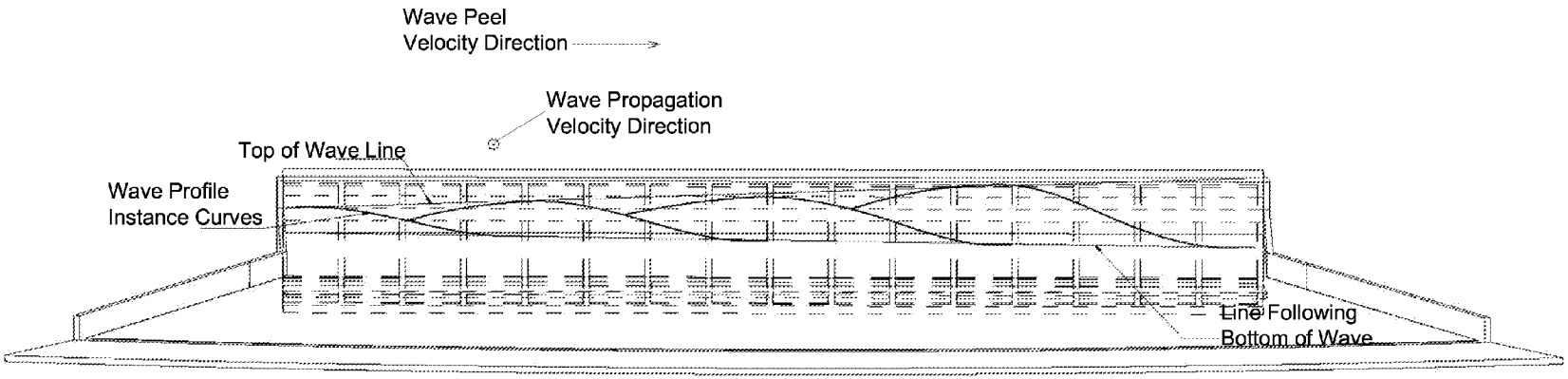
FIG. 6 is a view from the beach side or the side opposite the wave generating chambers of the pool. It shows the progression of the wave as it flows and how the height increases at various instances.

As illustrated in FIG. 6, the wave increases in height as it continues to flow and the chambers 54 continue to push the wave. The wave size increases as a result of each chamber 54 releasing water into the pool, which pushes into the same piece of wave, causing it to amplify. The same piece of wave is pushed when the each chamber actuates. This process continues through the beginning portion of the sequence or first few chambers until the wave reaches its maximum height. If there are too few chambers 54, the wave may not be smooth enough to ride. Likewise, if the chambers 54 produce a wave too big, it may be too choppy and not smooth enough to ride.

Figure 4:
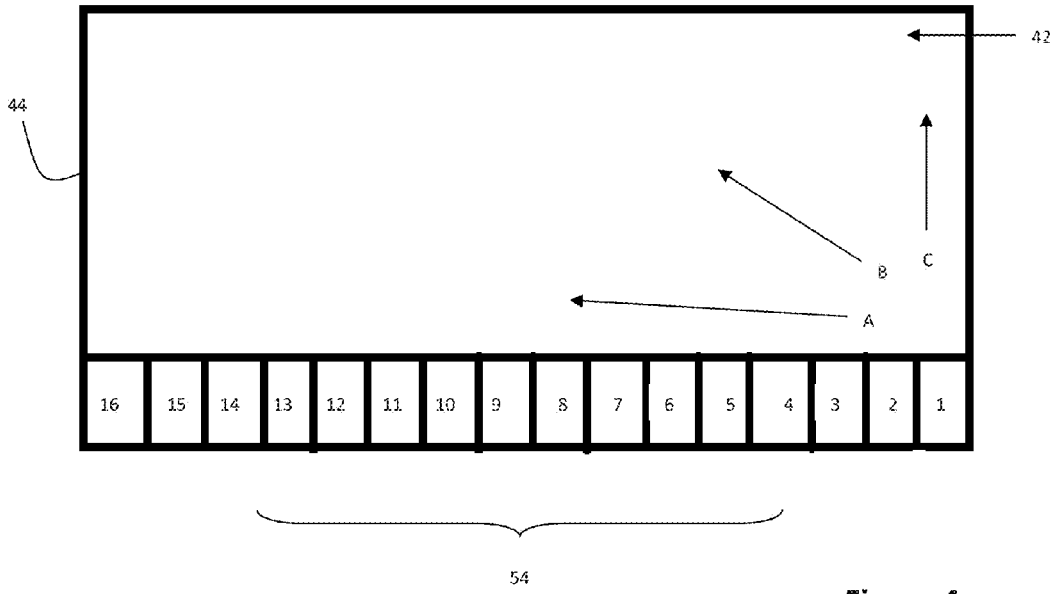
FIGS. 4-5 are top views of one example embodiment of a wave generator apparatus in a wave pool showing multiple directions that the wave can flow depending on the amount of delay in the sequence.

The direction of the peak is determined by the delay in the sequencing of the chambers. FIG. 4 illustrates the different directions the peak can travel depending on the delay between the chambers. For example, if there is no delay and each chamber 54 actuates at the same time, the peak may travel perpendicular to the chambers in direction C towards the beach 42. When the controller 62 uses sequencing for a delay between each chamber 54, the peak may travel in more of an angled direction in order of the sequence. Here, in FIG. 4, the sequence starts with chamber 1 actuating, then chamber 2, then chamber 3, and continuing down the plurality of chambers 54 until chamber 16 actuates. The peak may flow towards side 44 when this sequence continues.

An increase in the delay sequence may cause the peak to travel in a direction that is more angled towards side 44. For example, a shortened delay in the sequence would result in the peak traveling in direction B, which flows more towards side 44. When increasing the delay even more, the peak can travel not substantially perpendicular to the chambers 54 towards side 44 in direction A.

Figure 5:
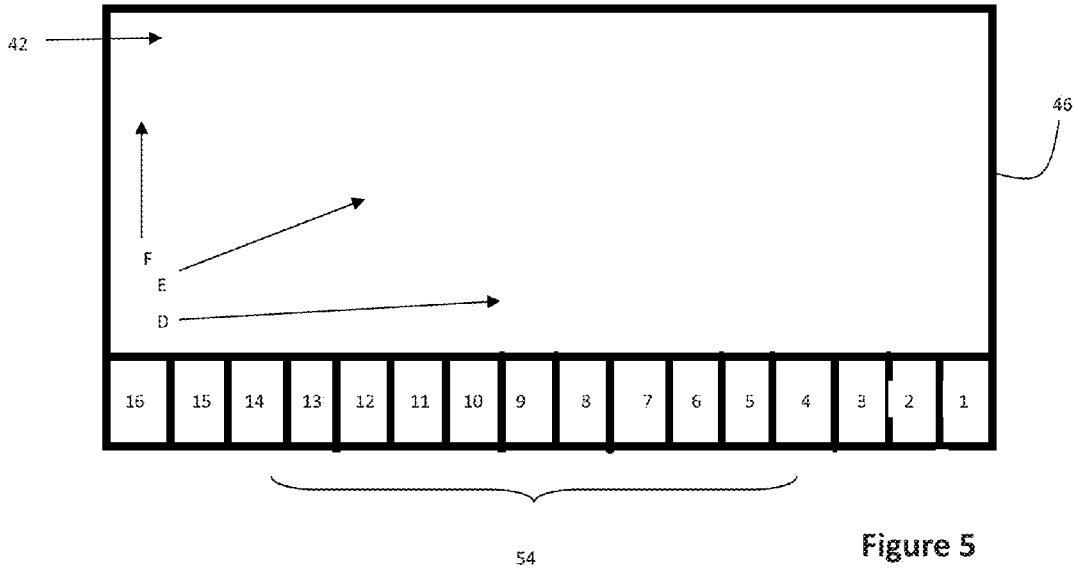

As illustrated in FIG. 5, the peak can also travel in the other direction towards side 46. To do so, the sequence would have to start at chamber 16 and end at chamber 1. A shortened delay between the controller 62 actuating the chambers may result in the peak traveling in somewhat of an angle towards side 46, in direction E. A longer delay between the controller 62 actuating the chambers can result in the peak traveling not substantially perpendicular to the chambers in direction D, towards side 46. Also, chambers 16 and 1 could be actuated at the same time, then the adjacent chamber actuated after a delay, and so on, such that two wave peaks are created one moving in direction D (FIG. 5) and one moving in direction A (FIG. 4).

Figure 7:
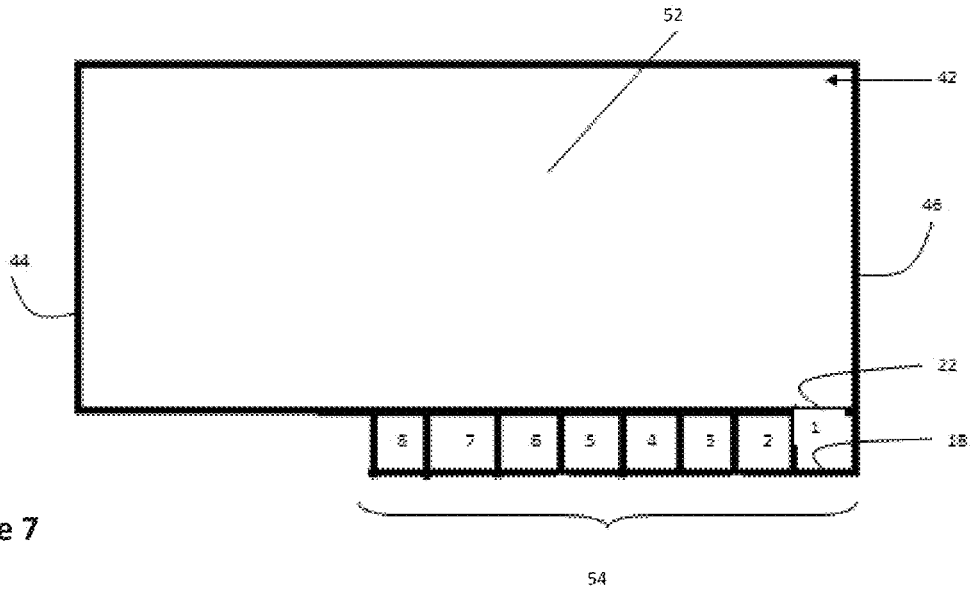
FIG. 7 is a top view of one example embodiment of a wave generator apparatus in a wave pool with the side wall extending beyond the wave generating chambers.

FIG. 7 illustrates an example embodiment where the pool 52 extends beyond the chambers 54. This allows the wave to continue to travel after the sequence is complete, thus allowing a rider more time to ride the created wave.

The above description of the disclosed example embodiments is provided to enable any person skilled in the art to make or use the invention. Various modifications to these example embodiments will be readily apparent to those skilled in the art, and the generic principles described herein can be applied to other example embodiments without departing from the spirit or scope of the invention. Thus, it is to be understood that the description and drawings presented herein represent a presently preferred example embodiment of the invention and are therefore representative of the subject matter which is broadly contemplated by the present invention. It is further understood that the scope of the present invention fully encompasses other example embodiments that may become obvious to those skilled in the art and that the scope of the present invention is accordingly limited by nothing other than the appended claims.

The invention claimed is:

1. An aquatic sports amusement apparatus, comprising:

a pool which holds a body of water, the pool having a first and second end, two sides, and a floor;

a plurality of wave generating chambers that communicate with the body of water so as to release water into the pool, the chambers located adjacent to each other on one of the ends of the pool;

each of the plurality of chambers having a valve structure, wherein each valve structure is connected to a controller wherein the connection is constructed to allow for the actuation of the each valve structure independently of the other valve structures; and the controller operates each valve structures independently, the operation comprising the steps of:

actuating each valve structure in a sequenced fashion to release water into the pool from each chamber in the plurality;

creating a wave, wherein the wave comprises a peak defined as the highest water level in the pool; and traveling the peak in a direction that is not substantially perpendicular to the ends of the pool.

2. The apparatus of claim 1, wherein the controller operation comprises the following steps:

a. actuating the valve structure of a first chamber in the plurality to release water into the pool;

b. after a delay, actuating the valve structure of a second chamber in the plurality to release water into the pool; and c. after a delay, actuating the valve structure of a third chamber in the plurality to release water into the pool.

3. The apparatus of claim 2, wherein the controller operation further comprises the following steps:

d. after the first chamber has released its water, actuating the valve structure of the first chamber to refill the first chamber with water to a predetermined level, wherein the time to release the water and refill to the predetermine level is defined as the chamber period;

wherein the delay of steps (b) and (c) is a fraction of the chamber period and the fraction is 0.10-0.75.

4. The apparatus of claim 3, wherein the valve structure of each of the plurality of chambers comprises an air valve and a vent valve, wherein step (a) further comprises filing the chamber with air through the air valve, and wherein step (d) further comprises closing the air valve and opening the vent valve.

5. The apparatus of claim 4, wherein the air valve and vent valve comprise a single two way valve.

6. The apparatus of claim 2, wherein the delay in step (b) is of a different length than the delay in step (c).

7. The apparatus of claim 2, wherein the controller operation further comprises the following steps:

after the first chamber has released its water, actuating the valve structure of the first chamber to refill the first chamber with water to a predetermined level, wherein the time to release the water and refill to the predetermine level is defined as the chamber period;

wherein the delay of steps (b) and (c) is selected to adjust the travel direction of the peak of the wave.

8. The apparatus of claim 2, wherein the controller operation further comprises the following steps:

after the first chamber has released its water, actuating the valve structure of the first chamber to refill the first chamber with water to a predetermined level, wherein the time to release the water and refill to the predetermine level is defined as the chamber period;

wherein the delay of steps (b) and (c) is a fraction of the chamber period and the fraction is selected to adjust the amplitude of the wave peak.

9. The apparatus of claim 1, wherein the floor of the pool is inclined.

10. The apparatus of claim 1, wherein the pool length is longer than the plurality of the chambers, wherein the peak of the wave may travel and can continue to be ridden beyond the chambers.

11. A method of generating waves in a pool of water, comprising:

providing a pool which holds a body of water, the pool having:

a plurality of wave generating chambers that communicate with the body of water so as to release water into the pool, the chambers located adjacent to each other on an edge of the pool;

each of the plurality of chambers having a valve structure, wherein each valve structure is connected to a controller wherein the connection is constructed to allow for the actuation of the each valve structure independently of the other valve structures;

a. actuating the valve structure of a first chamber in the plurality to release water into the pool and during step (a) the valve structures of a second and third chambers of the plurality are actuated so as to prevent the release water into the pool;

b. after a delay, actuating the valve structure of a second chamber in the plurality to release water into the pool and during step (b) the valve structures of the first and third chambers of the plurality are actuated so as to prevent the release water into the pool; and c. after a delay, actuating the valve structure of a third chamber in the plurality to release water into the pool and during step (c) the valve structures of the first and second chambers of the plurality are actuated so as to prevent the release water into the pool.

12. The method of claim 11, wherein the sequenced fashion comprises:

after the first chamber has released its water, refilling the first chamber with water to a predetermined level, wherein the time to release the water and refill to the predetermine level is defined as the chamber period;

wherein the delay of steps (b) and (c) is a fraction of the chamber period and the fraction of each delay is 0.10-0.75.

13. The method of claim 12, wherein the fraction of the chamber period for each chamber is selected to adjust the amplitude of the peak.

14. The method of claim 12, wherein the fraction of the chamber period for each chamber is selected to adjust the direction of the peak.

15. The method of claim 11, wherein the delay in step (b) is of a different length than the delay in step (c).

16. An aquatic sports amusement apparatus, comprising:

a pool;

a plurality of wave generating chambers that communicate with the pool so as to release water into the pool;

each of the plurality of chambers having a valve structure, wherein each valve structure is connected to a controller wherein the connection is constructed to allow for the actuation of each valve structure independently of the other valve structures; and the controller operates each valve structure independently, the operation comprising the steps of:

a. actuating the valve structure of a first chamber or valve structures or a first set of chambers in the plurality to release water into the pool, during step (a) the valve structure of a second chamber or the valve structures of a second set of chambers of the plurality are actuated so as to prevent the release water into the pool; and b. after a delay, actuating the valve structure of a second chamber or the valve structures of a second set of chambers in the plurality to release water into the pool, during step (b) the valve structure of the first chamber or the valve structures of the first set of chambers of the plurality are actuated so as to prevent the release water into the pool; and wherein the release of water into the pool creates a wave that can be ridden by a user.

17. The apparatus of claim 16, wherein the controller operation further comprises the following steps:

c. after a delay, actuating the valve structure of a third chamber or the valve structures of third set of chambers in the plurality to release water into the pool, during step (c) the valve structure of the first and second chambers or the valve structures of the first and second sets of chambers of the plurality are actuated so as to prevent the release water into the pool.

18. The apparatus of claim 17, wherein the controller operation further comprises the following steps:

d. after a delay, actuating the valve structure of any subsequent chamber or valve structures of any subsequent set of chambers in the plurality to release water into the pool, during step (d) the valve structure of the first, second and third chambers or the valve structures of the first, second and third sets of chambers of the plurality are actuated so as to prevent the release water into the pool.

* * * * *